US005220704A

United States Patent [19]

Flynn et al.

[11] Patent Number: 5,220,704

[45] Date of Patent: Jun. 22, 1993

[54] ERGONOMIC TOOL SUPPORT APPARATUS AND MATERIAL REMOVAL SYSTEM

[75] Inventors: Thomas S. Flynn, Larkspur; Tadeusz M. Krzanowski, San Anselmo; Gary W. Bayne, Pleasant Hill, all of Calif.

[73] Assignee: AEI, Emeryville, Calif.

[21] Appl. No.: 702,765

[22] Filed: May 17, 1991

Related U.S. Application Data

[63] Continuation-in-part of Ser. No. 649,663, Feb. 1, 1991, abandoned.

[51] Int. Cl.[5] ..... A47L 9/00

[52] U.S. Cl. ..... 15/321; 15/327.5; 15/410; 224/200; 224/266

[58] Field of Search ..... 15/327.5, 321, 410; 224/200, 261, 262, 265, 266

[56] References Cited

U.S. PATENT DOCUMENTS

| | | | |
|---|---|---|---|
| 2,271,136 | 1/1942 | Geiger | 224/200 |
| 2,547,818 | 4/1951 | Gould | 224/265 X |
| 2,606,701 | 8/1952 | Huthsing | 224/5 |
| 2,792,670 | 5/1957 | Haynes | 47/1 |
| 3,127,077 | 3/1964 | Faro | 224/26 |
| 3,165,774 | 1/1965 | Barba | 15/327.5 X |
| 3,286,884 | 11/1966 | Long | 222/131 |
| 3,987,869 | 10/1976 | Bowers | 184/105 R |
| 4,037,763 | 7/1977 | Turchen | 224/5 |
| 4,081,115 | 3/1978 | White et al. | 224/200 |
| 4,298,149 | 11/1981 | Gottschalk et al. | 224/262 X |
| 4,748,712 | 6/1988 | DiGiovanni | 15/327.5 |
| 4,944,065 | 7/1990 | Svanberg | 15/327.5 |
| 4,991,758 | 2/1991 | Eaneff | 224/200 X |

*Primary Examiner*—Chris K. Moore

*Attorney, Agent, or Firm*—McCubbrey, Bartels, Meyer & Ward

[57] ABSTRACT

This invention is a portable support apparatus comprising a mounting frame or yoke which can be supported about the hips of a worker or be attached to a machine or robot. A pivoting assembly pivots a rod having one end secured to the pivoting assembly to adjust the rod angle relative to the mounting yoke. A head assembly attachment means is secured to the rod at its other end, and is adjustable to a plurality of pitch angles relative to the rod to facilitate contact with the surface to be worked on. A head assembly is attached to the rod which may support a variety of material-removing devices including scrubbers, brushes, and scrapers, all of which can rotate circularly or eccentrically or vibrate to facilitate removal of material from surfaces. The head assembly also may include fluid projection nozzles, and vacuum apertures for connection to vacuum systems for removal of materials. The head assembly may also be adapted for use as a tool for the application of various substances on a surface.

11 Claims, 6 Drawing Sheets

ERGONOMIC TOOL SUPPORT APPARATUS AND MATERIAL REMOVAL SYSTEM

This application is a continuation-in-part of application U.S. Ser. No. 649,663, filed Feb. 1, 1991, and now abandoned.

FIELD OF THE INVENTION

The present invention relates generally to the field of removing and applying materials on a surface and more particularly to an apparatus for facilitating and perfecting the processes both by an ergonomic apparatus support structure and efficient and safe removal instruments.

BACKGROUND OF THE INVENTION

Because of its physical resistance to heat and chemicals, asbestos has been a major component of building materials for a number of years. During the period from 1950 to 1974 in the United States, thousands of tons of asbestos-containing material (ACM) was sprayed into buildings to provide fireproofing and acoustical insulation. ACM was also applied as thermal insulation for water pipes and heating and ventilation ducts.

ACM is typically a composite dry mixture which includes asbestos fibers and particles. The mixture is sometimes coagulated by a glue-like binder which also bonds the material to surfaces such as ceilings, wall, floors, and beams. Asbestos itself was also used as a binder in building materials because the asbestos fibers have good cohesive and adhesive properties.

It is now well known that exposure to airborne asbestos poses serious hazards to health. In particular, exposure of friable (easily crumbled) asbestos has been linked to diseases such as asbestosis, mesothelioma, and cancer of the lung. To reduce the frequency of exposure to asbestos, most forms of ACM are removed whenever buildings are re-modeled or renovated.

Procedures for the removal of are set forth in EPA Regulations (40 CFR, Part 61, Subparts A & B, 1973). Among these procedures are the important aspects of protecting the workers engaged in removing the materials, minimizing airborne asbestos concentrations during removal, and controlling and collecting the removed materials.

The process for removal of sprayed on asbestos-containing materials typically begins by wetting the materials using various well known wetting agents. The next step is to manually scrape the surface using metal scrapers such as those used for removing paint and tile. After gross removal of asbestos-containing materials by scraping, residual material is further removed by scrubbing with brushes and pads and the like in a process known as "detailing". The standard for detailing is removal of all visible asbestos containing materials. After detailing the surface, the removed asbestos-containing mat collected using shovels, squeegees, mops, and the like. Vacuums have also been used to collect removed asbestos-containing materials from the work site.

A variation of the removal process is to use high pressure water blasting ("hydroblasting") of the asbestos-containing materials which can achieve faster removal. However, hydroblasting has the following drawbacks:

1. Hydroblasting results in large amounts of asbestos contaminated waste on the jobsite which greatly increases the likelihood of water leaks which can cause water damage and contamination outside the work areas.
2. The high pressure water causes an explosive disturbance of the asbestos material which results in significant increase in asbestos fibers suspended in the air of the work area and consequent increased exposure to workers.
3. Hydroblasting can cause serious physical injury and has on jobsites caused loss of limbs, fingers and nearly decapitated a worker.
4. The force involved in hydroblasting can cause a breach in containment and can drive asbestos materials into areas adjacent to the work area as well as impact asbestos into difficult access areas where the asbestos may cause exposure in the future.
5. Hydroblasting greatly scatters the asbestos containing material often to locations in and around fixtures such as pipe hangers where it previously wasn't applied.

From the above description, it can be appreciated that the removal of asbestos-containing materials (or any materials bonded to a surface) is a long, tedious, expensive, and hazardous undertaking. Indeed, anyone who has removed paint or varnish and the like from furniture or walls is cognizant of the tedium, expense, and hazards of the endeavor.

In particular, the removal or application of materials from and to overhead surfaces presents even further difficulties and hazards. For example, anyone who has prepared and painted a ceiling knows all too well the fatigue engendered by the simple task of holding up a scraper or brush for any period of time, no matter how short. Adding to this, the scraping or brushing motion required results in an arm- and back-aching experience. Further, there are the dangers of materials to be applied or removed dropping from the ceiling onto the person or floor. In total, the job is extremely tiring, unpleasant, and hazardous. In the context of large buildings having ceilings of extensive area, the job is difficult. Add to this the dangers of exposure to asbestos and the job becomes extremely dangerous as well.

Therefore, there is clearly a strong need for devices and systems which will alleviate the difficulties and dangers of the removal and application of materials from surfaces, particularly overhead surfaces, and increase the speed and efficiency of the processes.

SUMMARY OF THE INVENTION

Accordingly, it is a principal object of the present invention to provide a tool support apparatus for overhead work.

It is a further object of the present invention to provide a materials removal system including a tool support apparatus and tools for removing materials from a surface.

It is still a further object of the present invention to provide an asbestos removal system for facilitating the removal of asbestos-containing materials.

This invention is a portable support apparatus comprising a mounting frame which can be supported about the hips of a worker or be attached to a machine or robot. There is a pivoting assembly connected to one end of the mounting frame and a shaft having one end secured to the pivoting assembly and being adjustable to a plurality of shaft angles relative to the mounting frame by the pivoting assembly. A head assembly attachment means is secured to the rod at its other end, and is adjustable to a plurality of pitch angles relative to the shaft by the head assembly attachment means to facilitate contact with the surface to be worked on.

The head assembly may have a variety of material-removing devices including scrubbers, brushes, and scrapers, all of which can rotate or vibrate to facilitate removal of material from surfaces. The head assembly also may include fluid projection nozzles for spraying fluids on surfaces (for removal or coating procedures) and may include vacuum apertures for connection to vacuum systems for removal and conveyance of materials. The head assembly may also include a means to provide containment around the area where removal is occurring to prevent dispersal and enhance collection. This containment may be provided by a shield, screen, or shroud which is movable and adaptable to various surfaces. The head assembly may also be adapted for use as a tool for the application of various substances on a surface.

A further understanding of the nature and advantages of the present invention may be realized by reference to the Detailed Description of the Invention and the attached drawings.

DETAILED DESCRIPTION OF THE INVENTION

Figure 1:
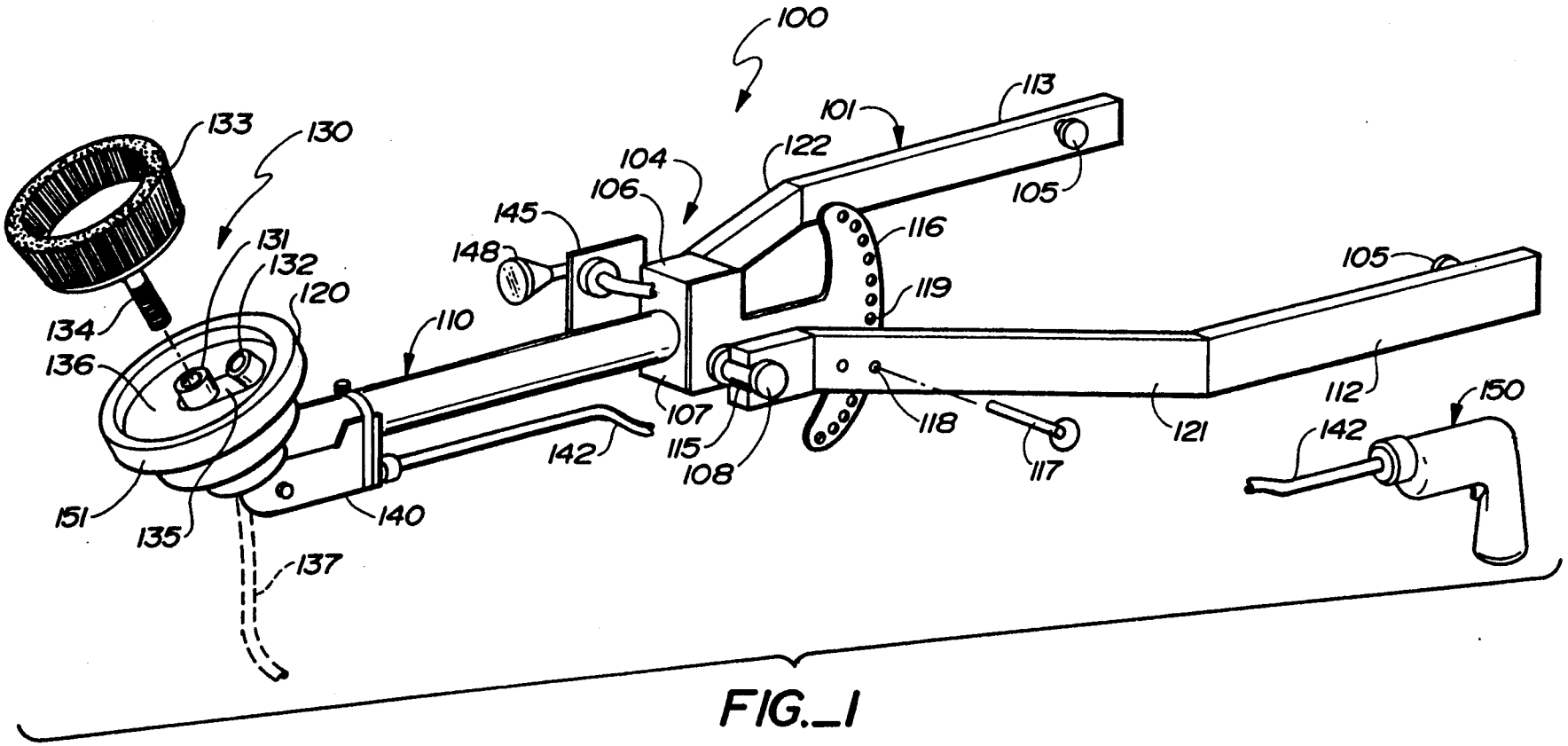
FIG. 1 is a perspective view of an ergonomic support apparatus having a representative head assembly in a preferred embodiment of the present invention.

FIG. 1 is a perspective view of a preferred embodiment of the present invention at 100. A mounting yoke 101 has sides 112 and 113, and 121 and 122 which form an opening for a pivoting assembly 104. Secured to pivoting assembly 104 is one end of a rod 110 having mounted on its other end a head assembly attachment means 120. Attached to head assembly attachment means 120 is an exemplary head assembly 130. Yoke 101 may be supported on a suitable structure or belt (not shown) by means of pivot knobs 105 on the inner surfaces of sides 112 and 113.

Alternatively or additionally, a separate counterweight assembly, not shown, may be mounted the ends of the yoke opposite the assembly 104 may be mounted on to serve a weight balancing function. It is understood that any form of adjustment of the dimensions of mounting yoke 101 suitable for the purpose of mounting the yoke 101 on the desired subject person or machine is contemplated by the present invention. Yoke 101, pivoting assembly 104, rod 110, and head assembly attachment means 120 may be constructed of any suitable material, for example aluminum.

It is understood that yoke 101 may have any suitable shape, rectangular, elliptical, circular, and the like, as its function is to provide a frame for placement about a person, robot, or machine for securing rod 110, pivoting assembly 104, head assembly attachment means 120 and head assembly 130. Yoke 101 can be sized to be mounted on a human being, a robot, or a machine.

Pivoting assembly 104 includes a block 106 with an aperture 107 for receiving rod 110. On the sides of block 106 are disposed axis pins 108 and 109 (not shown) for registration with grooves 114 (not shown) and 115 of 101. At the end of block 106 opposite aperture 107 is disposed a pivot angle locking mechanism 116. By the insertion of locking pin 117 through an aperture 118 in yoke 101 and one of the apertures exemplified by aperture 119 of locking mechanism 116, the angle of pivot of rod 110 may be fixed. If desired, locking mechanism 116 can also serve as a counterweight for pivoting assembly 104, rod 110, head assembly attachment means 120, and head assembly 130.

In one embodiment of the present invention, head assembly 130 comprises a scrubber 133 having a rotational shaft 134. A bed 136 has disposed therein a first bit 131 disposed centrally to bed 136 and a second bit 132 disposed off-center in bed 136. Around the perimeter of bed 136 is a ring 151 that can rotate. A shroud, not shown in FIG. 1, is attached to the ring 151 for purposes more particularly described below. Bits 131 and 132 comprise a chuck 135. By insertion into the appropriate bit, scrubber 133 may be actuated in a variety of motions such as fixed axis or wide and narrow eccentric motions.

Mounted on rod 110 and attached to head assembly attachment means 120 is a motor drive connector 140 for driving the head assembly 130. Cable 142 connects motor drive connector to a motor 150. Motor 150 may be actuated by a trigger mechanism mounted on the yoke 101 or mounted proximate head assembly attachment means 120.

Additionally or alternatively, a fluid nozzle may be disposed in the position of bit 131 and/or bit 132 for the introduction of fluid for application on a surface. Fluid, such as water or steam for hydroblasting, may be advantageously utilized by itself or in conjunction with scrubber 133. Fluid also can be ejected from other places on the head assembly where nozzles or openings can be positioned. In a combination scrubbing and fluid application use, a fluid nozzle is disposed at either bit 131 or bit 132 while scrubber shaft 134 is inserted in the empty bit. A suitable hose 137 connected to fluid nozzle 131 or 132 is attached to transmit the fluid from a suitable pumping reservoir (not shown).

Mounted on a support plate 145 which is attached to block 106 is a light 148 for illuminating the work surface.

Figure 2:
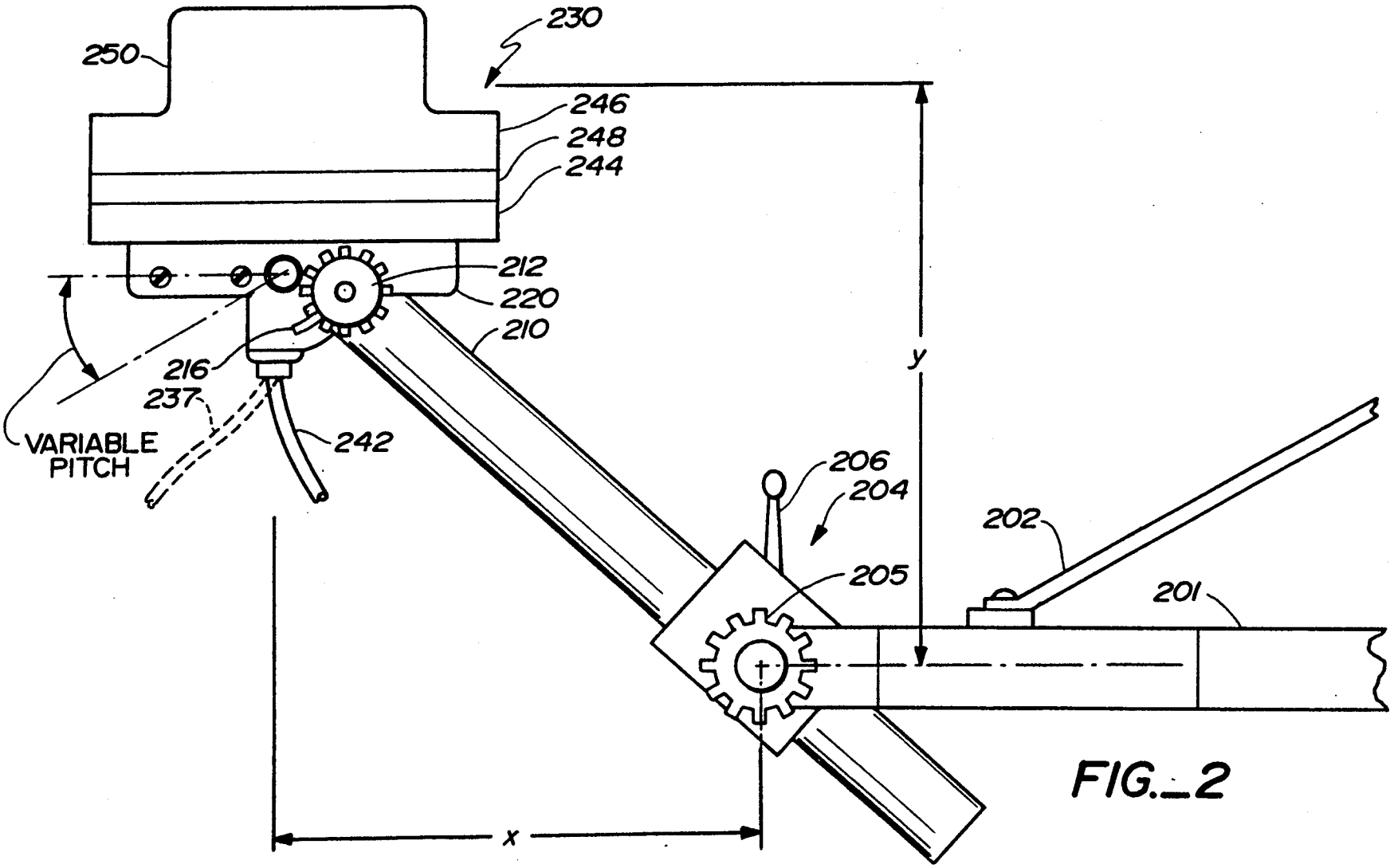
FIG. 2 is a side view showing the pivot angle and pitch angle mechanism in an alternative embodiment of the present invention.

FIG. 2 is a side view showing the pivot angle and pitch angle mechanism in an alternative embodiment of the present invention. Yoke 201 has secured to its open end a pivoting assembly 204 comprising a knurled lock-nut wheel 205 for adjusting the pivot angle of rod 210 and a locking lever 206 for locking the position of lock-nut wheel 205 at a desired pivot angle. At the other end of rod 210 is a second lock-nut wheel 212 and locking lever 216 for adjusting and locking the pitch angle of head assembly attachment means 220. A strap 202 may be secured to yoke 201 to assist in holding the entire apparatus in a desired position and distributing the load to backpack, vest, or other support system. Mounted on head assembly attachment means 220 is a head assembly 230. A cable 242 extends through head assembly attachment means 220 to head assembly 230 providing power to head assembly 230 for rotation or reciprocating motion of scrubbers, brushes, scrapers, and the like (not shown) which can be disposed in head assembly 230.

Alternatively, instead of or in addition to cable 242, a hose 237 or the like may be used for introducing fluids through head assembly attachment means 220 to head assembly 230 for hydroblasting surfaces proximate head assembly 230. Any suitable pressurized liquids could be advantageously utilized. Steam or other gaseous fluids could also be introduced through hose 237 at or near cable 242 to head assembly 230 to facilitate removal of material. If materials are to be applied to the working surface, paint, plaster, and the like could be introduced through hose 237 for application to a working surface. Fluids introduced in this way may be advantageously collected after contact with the working surface by head assembly 230 for transport through tube 210 to a safe containment vessel. This will reduce the hazards of fluid use for materials removal and materials application.

Rod 210 may alternatively be a hollow tube for transfer of material by vacuum, gravity, or other means, from head assembly 230 through head assembly attachment means 220 to a collector (not shown) attached to the other end of rod 210. This will be more clearly illustrated in subsequent figures.

A scraping mechanism such as that described in copending application Ser. No. 07/491,506, assigned to the assignee of the present invention, and now abandond may be advantageously employed in head assembly 230. Such a scraper comprises an actuating means for positioning the scraper proximate the surface to be worked and moving the scraper in a scraping motion. There are a plurality of scraper elements resiliently biased to maintain contact with the working surface even when such surface is rough and uneven. The scraper also may be vibrated (reciprocated) and/or rotated to enhance scraping efficiency. The scraper may also be driven in eccentric motions in the manner described above for the scrubber. The scraper motions may be driven by connection to a motor such as 150 (of FIG. 1) through cable 242. The scraper may also be advantageously utilized with hydroblasting or other fluid projection methods.

The head assembly 230 shown in FIG. 2, is mounted on the head assembly attachment means 220 by a rotatable ring 244. The ring 244 is rotatable with respect to the head assembly attachment means 220 and supports a shroud 246 by means of an attachment ring 248. By virtue of this arrangement, the shroud 246 is able to rotate with respect to the head assembly mounting means 220 and thus the remainder of the apparatus. The shroud 246 is provided with a pair of guide extensions 250, only one of which is visible in the drawings. These guide extensions are spaced apart a distance selected to be slightly greater than the distance of typical ceiling corrugations. Accordingly, the extensions 250 served as guides for the head assembly as it is moved along the ceiling corrugations maintaining the head assembly in the correct relationship to the corrugation. This also helps to maintain the containment provided by the shroud in spite of changes in position of the worker's supporting the apparatus.

Figure 3C:
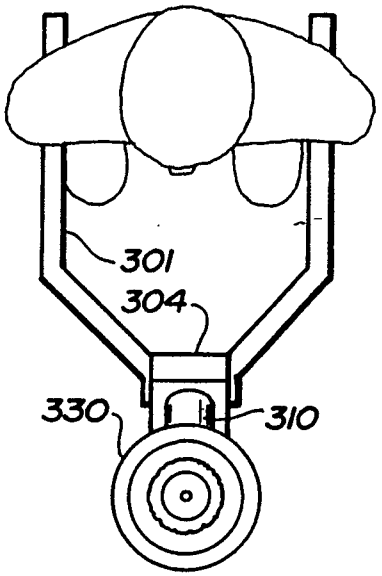
FIGS. 3A-3C show the present invention in operation as an asbestos-containing materials removal system operated by a human.
Figure 3B:
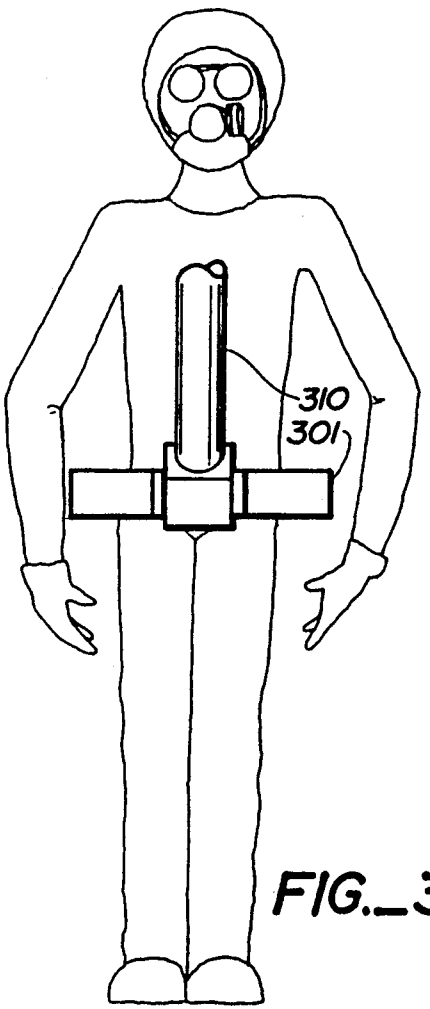
Figure 3A:
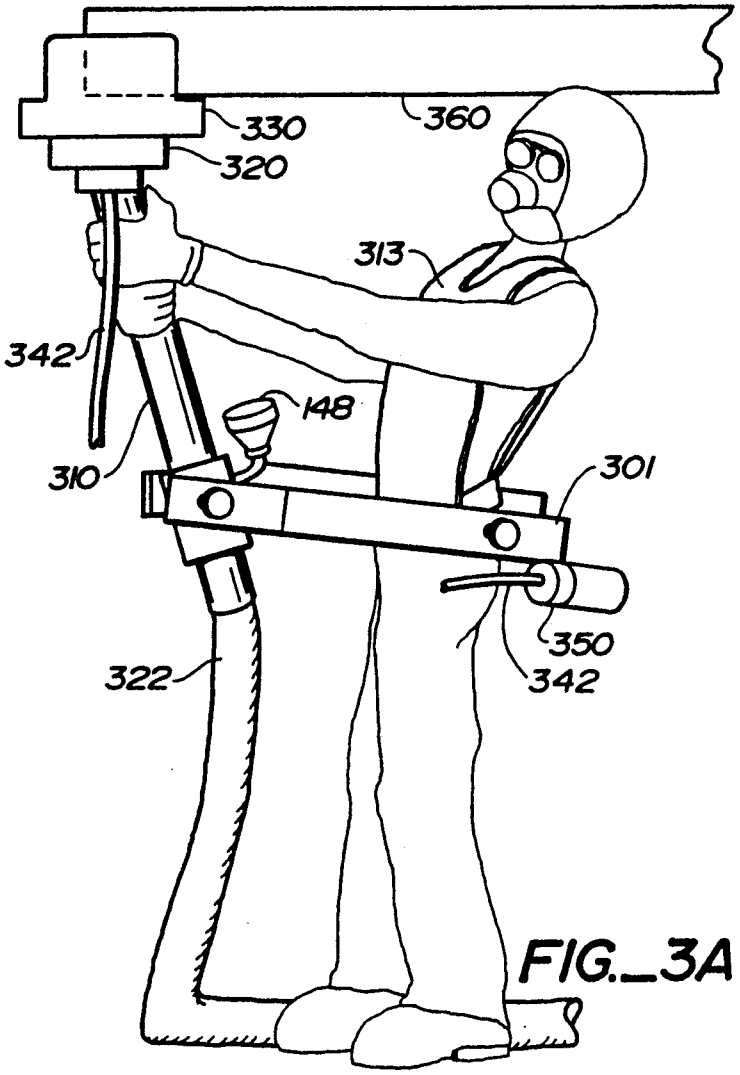

FIGS. 3A–3C show the present invention in operation as an asbestos-containing materials removal system operated by a human. FIG. 3A is a side view showing 301 adapted for mounting about the hips of a human and supported by a vest-like shoulder and body support garment 313. Head assembly 330 is proximate a work surface 360. Scrubbers and/or scrapers in head assembly 330, togerther with fluid for removal and rinsing, operate to remove asbestos-containing materials. The head assembly is driven by a motor 350 connected to head assembly 330 via cable 342. Fluid is provided to the head assembly by a hose, not shown. Head assembly attachment means 320 is attached to a hollow tube 310 which is turn is connected to a flexible hollow hose 322. Asbestos-containing material is collected in head assembly 330, is passed through head assembly attachment means 320, tube 310, and flexible hose 322, and is collected in a suitably protected container (not shown). A vacuum system may be advantageously utilized through flexible tube 322 to collect removed material efficiently and safely. This is particularly advantageous in asbestos removal because it will reduce the incidence of airborne asbestos exposure to workers.

As shown, the worker can easily support head assembly 330, head assembly attachment means 320, and tube 310 with the help of yoke 301. The pivot angle of tube 310 with respect to yoke 301 and the pitch angle of head assembly attachment means 320 with respect to work surface 360 can be adjusted advantageously to perform the task at hand. The worker's hands grasping tube 310 need only exert sufficient force to guide head assembly 330 in its path. Thus, the exertion normally necessary to hold head assembly 330 and head assembly attachment means 320 up is obviated. By walking forwards or backwards, or moving sideways, the worker can treat any area of surface 360 desired. Informal tests have shown that the removal of asbestos-containing materials formerly done at a rate of 100 square feet per day per person can be done using the present invention at a rate of 100 square feet per hour per person. This represents a factor of eight or greater advance in speed and efficiency. The increased speed and efficiency in turn reduces the exposure time to hazardous materials, thereby alleviating health hazards.

FIG. 3B is a front view showing yoke 301 and tube 310 in their relative positions with the worker. FIG. 3C is a top view showing 301, pivoting assembly 304, rod 310 and head assembly 330 in their relative positions with the worker.

Figure 4C:
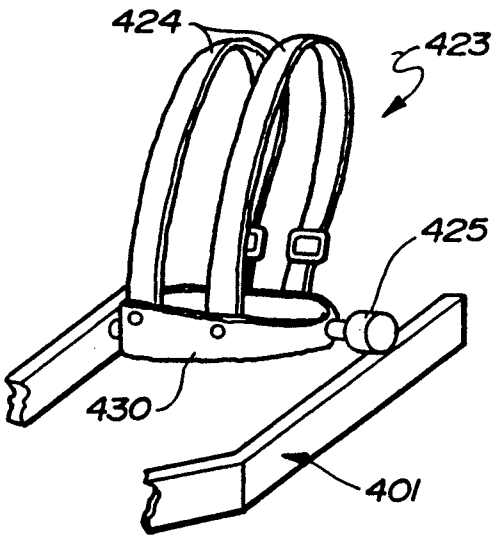
FIGS. 4A-4C show alternative mounting frame support devices in alternative embodiments of this aspect of the present invention.
Figure 4B:
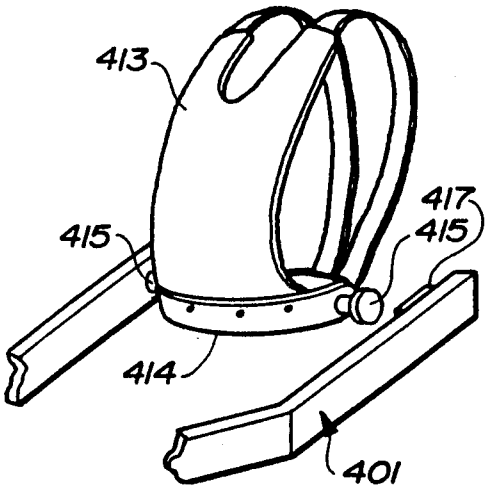
Figure 4A:
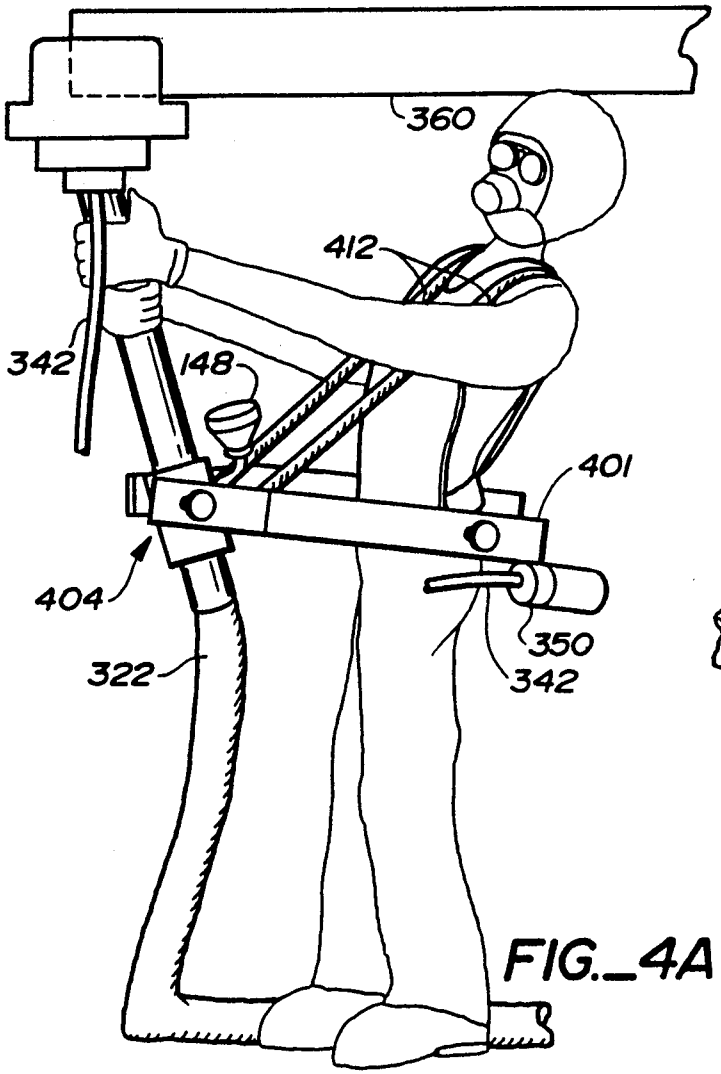

FIGS. 4A–4C show alternative embodiments of the present invention. FIG. 4A shows an asbestos-containing materials removing system operated by a human worker with straps 412 attached to yoke 401 at a position proximate pivoting assembly 404 and looped around the worker's neck. The straps 412 may, alternatively, be attached to a frame or other support, not shown. FIG. 4B shows a vest-type support device having a flexible material extending over a worker's shoulders and connected to a belt 414. Belt 414 has attachment knobs 415 for insertion into suitable receptacles 417 mounted on yoke 401. FIG. 4C shows an alternative girdle-type support device 423 comprising straps 424 attached to a girdle 430. Girdle 430 is likewise attached to yoke 401 by means of attachment knobs 425. It is understood that vest-like and girdle-like support devices are exemplary embodiments of two types of support devices of the present invention and that various modifications providing a support function are within the contemplation of the present invention.

Figure 5:
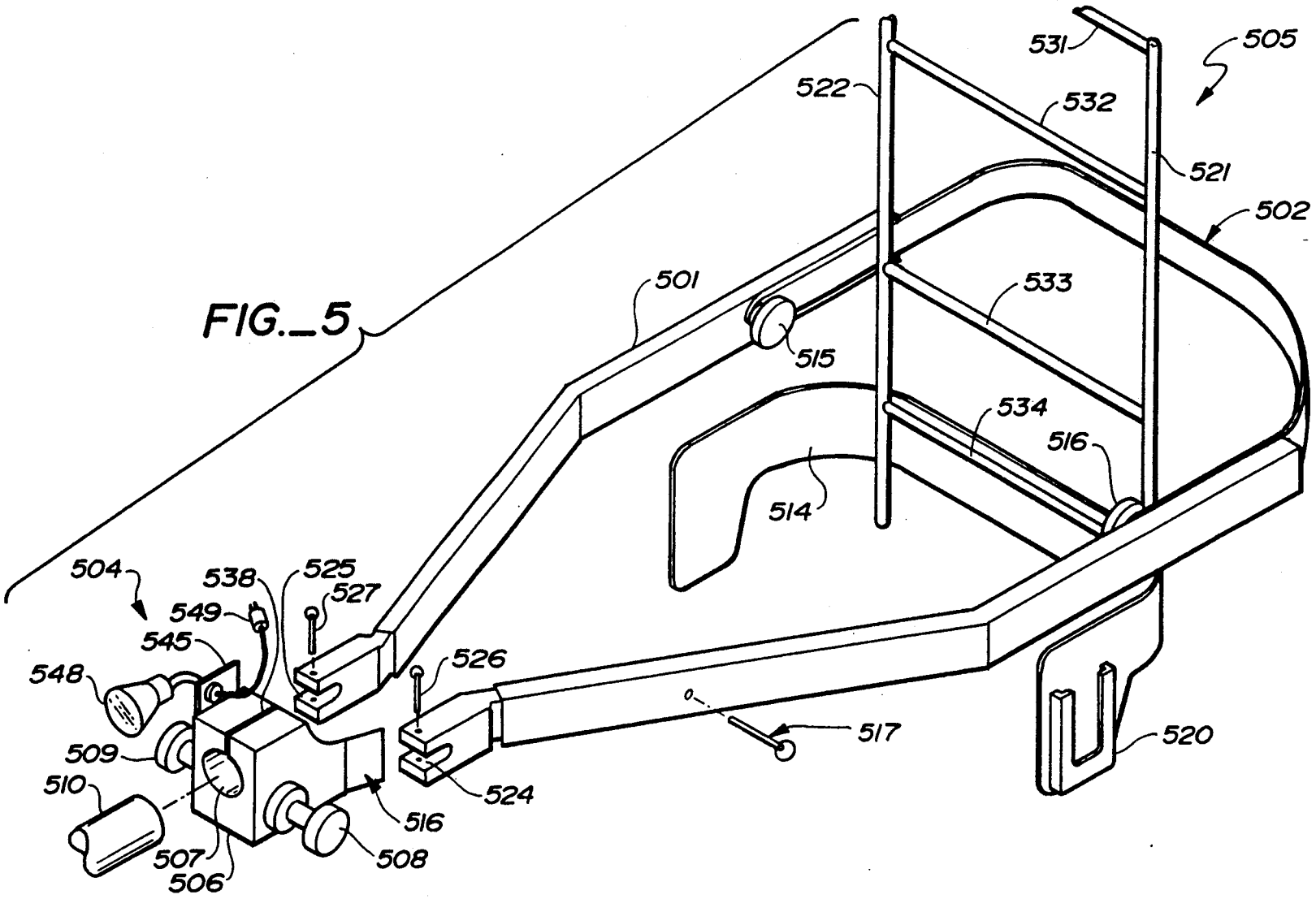
FIG. 5 shows an alternative mounting frame support device in the form of a backpack frame according to the present invention.

FIG. 5 shows an alternative mounting frame support device in the form of a backpack frame 505 and a more detailed view of a pivoting assembly 504. Frame 505 is a ladder type backpack frame having parallel sides 521 and 522 connected by a plurality of a cross bars as 531–534. Frame 505 is secured to a belt 514 having receptacles 520 for registration of knobs 515 and 516 attached to yoke 501. Note that yoke 501, in an alternative embodiment, has a back connector 502 secured between the free ends of yoke 501. Any suitable means of securing is contemplated by the present invention. Back connector 502 may also serve as a counterweight or have a counterweight mounted thereon (not shown).

Also shown in FIG. 5 is a more detailed view of a pivoting assembly 504 with a pivot angle locking mechanism 516 and locking pin 517 (such as locking mechanism 116 of FIG. 1) removed for clarity. Pivoting assembly 504 comprises a block 506 having axis pins 508 and 509 for registration into grooves 524 and 525 of yoke 501 and held in place by pins 526 and 527. Block 506 has an aperture 507 for a rod 510. There is a slit 538 traversing block 506 to aperture 507 for adjustments of the diameter of aperture 507. A light 548 for illuminating the work area is attached to block 506 by plate 545 and supplied with power through cord 549.

While the above description provides a full and complete description of the preferred embodiments of the present invention, various modifications, alternate constructions, and equivalents may be employed while still remaining within the scope of the invention. For example, although the above description is primarily in the context of the removal of asbestos-containing materials, the apparatus of the present invention may be advantageously utilized in the removal of any material from a surface.

Also the "backpack" structure may also be positioned in front of the worker since most of the weight is being born in front. In this case the "belt" or plate (aluminum or plastic) would be positioned at the front of the abdomen at the level of the wearer's pelvis.

Figure 6:
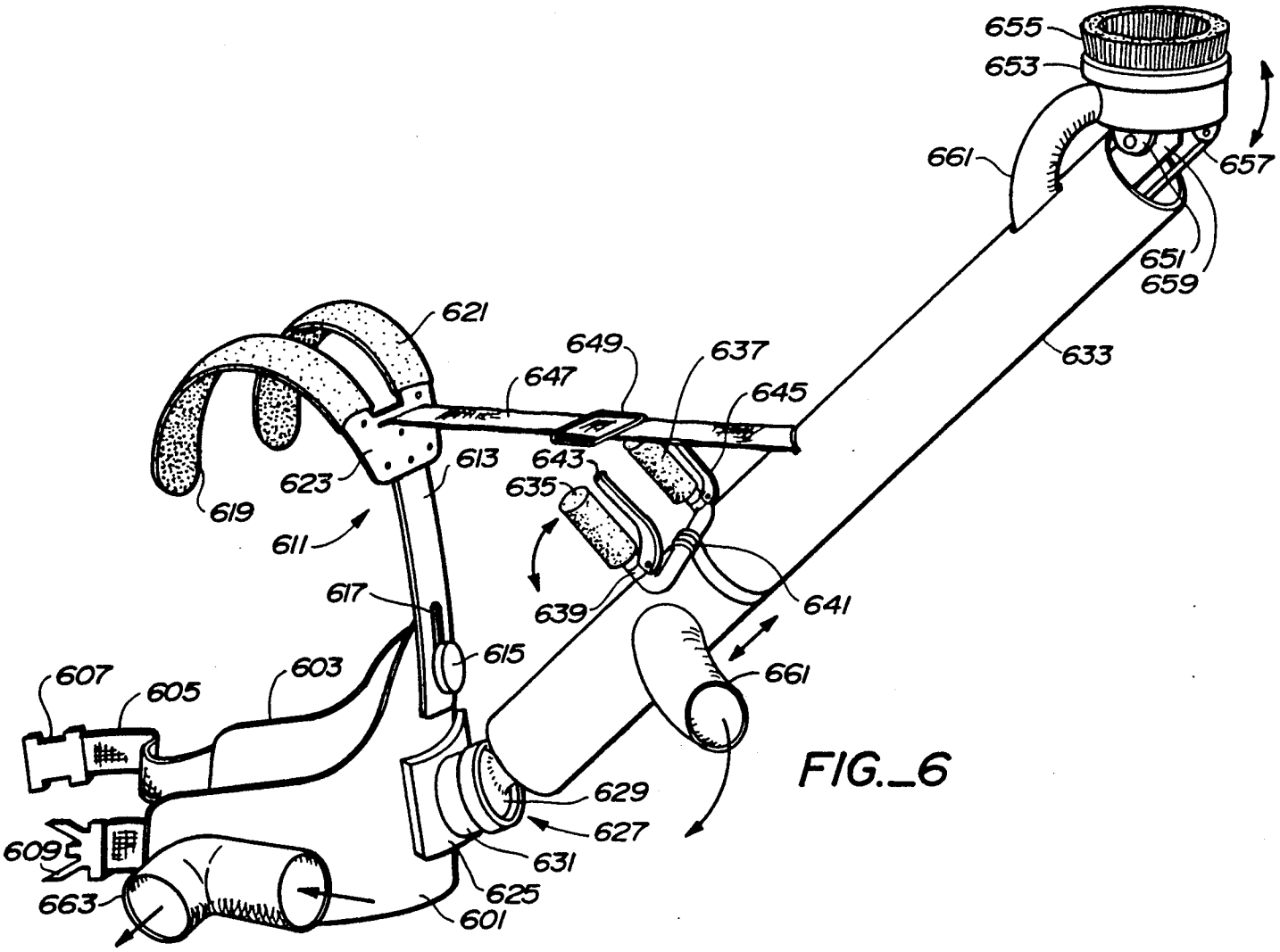
FIG. 6 shows a further embodiment of the invention employing a pelvic girdle with shoulder supports and a universal joint.

Referring now to FIG. 6, such a structure is shown. In FIG. 6, there is provided a semi-rigid pelvic girdle 601. The girdle 601 is comprised of a semi-rigid light weight material such as aluminum or plastic and is lined with a suitable padding material, such as foam 603. A flexible belt 605 is attached to the girdle 601 which extends around the back of the wearer. The belt 605 has a buckle 607 which inserts into a clasp 609 on the opposite side of the girdle 601 for securing the girdle about the hips and pelvis of the wearer. A shoulder support 611 is provided for the girdle 601. The shoulder support includes a bracket 613 which is secured to the girdle 601 by a knob operated screw 615. Adjustability of the height of the shoulder support 611 is provided by an elongated slot 617 in the bracket 613. A pair of shoulder straps 619 and 621 are secured to the bracket 613 by means of a riveted mounting plate 623. The straps 619 and 621 extend over the top of the shoulders of a wearer of the device and support the girdle 601 at the desired height.

The front of the girdle 601 is provided with a mounting plate 625 riveted to the girdle. The mounting plate 625 supports a pivot assembly 627 proximate the front of the wearer's pelvis. In the illustrated embodiment, the pivot assembly 627 comprises a ball and socket arrangement having a ball 629 and a socket 631. Any suitable universal joint arrangement may be utilized. Thus, for example, the ball and socket arrangement shown in the illustrated embodiment may be replaced by a wind surfer mast step or other type of universal joint assembly.

The ball 629 is secured to an elongated rod 633 which, in the illustrated embodiment, comprises an elongated hollow tubular structure. The rod 633 may be made of any light weight structural material, such as a plastic or aluminum. The elongated rod may be moved to a plurality of rod angles relative to the girdle 601 as a result of the pivot assembly 627. To facilitate this, a pair of handles 635 and 637 are mounted on the rod 633 by means of a U-shaped support 639 and a mounting bracket 641. By use of the handles 635, the rod 633 may be positioned by the operator as desired. In addition, an internal mechanism is provided, as will be explained subsequently, so that movement of the handles 635 and 637 relative to the rod 633 causes movement of, and adjustment of, the position of the head assembly, described below, relative to the rod 633. Control handles 643 and 645 are provided adjacent the handles 635 and 637, respectively, to enable the operator to control the flow of fluid to the head and the flow of vacuum therefrom as described below.

An adjustable tether 647 is connected between the plate 623 and the approximate mid point of the rod 633 for providing added support for the rod 633. The tether 647 is adjustable by a buckle 649 to vary the angle of the rod 633 with respect to the girdle 601.

The end of the rod 633 opposite the pivot assembly 627 is provided with a head mounting assembly 651. The assembly 651 is for the purpose of pivotally supporting a head assembly 653 which, in the illustrated embodiment, includes a rotary brush 655 for removing or otherwise engaging with material on an overhead surface, not shown. The angle of the head assembly 653 with respect to the rod 633 may be adjusted by means of an adjusting link 657. The adjusting link 657 passes within the tubular rod 633 to an adjusting mechanism, not shown, internal of the rod 633. Movement of the handles 635 and 637, as described before, relative to the rod 633 causes movement of the adjusting link 657 and thus adjustment of the head assembly with respect to the rod 633.

As was the case in the previously described embodiments of the invention, fluid, such as water or steam, is passed to the head assembly 653 through a suitable conduit, not illustrated in the figure. Rotation of the brush 655 is provided by a drive system, a portion of which is visible at 659. A vacuum hose 661 extends from the head assembly 653 through an opening in the rod 633 and then passes from the rod 633 through a second opening adjacent the handles 635 and 637. The hose 661 may be connected to a suitable vacuum source, not shown, for removing material from the head assembly 653. For purposes for compactness, it is preferable that the vacuum hose 661 be secured to one side of the girdle 601, shown at 663 in the drawing.

Further, the support apparatus may be advantageously used to apply materials to a surface as well as to remove them. For example, the application of plaster or paint or the like to ceilings would be greatly facilitated by the use of the support apparatus in conjunction with spray nozzles, brushes or pads or the like.

Therefore, the above description and illustrations should not be construed as limiting the scope of the invention which is defined by the following claims.

What is claimed is:

1. A support apparatus for enabling a human worker to support a head assembly against an overhead surface, comprising:

a pivot assembly;

harness means for supporting said pivot assembly on the human worker proximate the front of the worker's pelvis;

elongated rod means for supporting the head assembly, said elongated rod means including oppositely disposed first and second rod ends, said rod means being supported at said first rod end by said pivot assembly for movement to a plurality of rod angles relative to said harness assembly;

and head assembly attachment means for attaching and supporting the head assembly for engagement with the overhead surface, said head assembly attachment means being disposed on said second rod end of said elongated rod means opposite said pivot assembly for supporting a head assembly for engagement with the overhead surface.

2. A support apparatus according to claim 1 including adjustment means on said elongated rod means and attached to said head assembly attachment means for adjusting the angle of the head assembly relative to said rod means.

3. A support apparatus according to claim 1 wherein said harness means include a shoulder support for supporting said harness means on the shoulders of the human worker, and further including an adjustable tether extending from said shoulder support to said elongated rod means for supporting said elongated rod means from said shoulder support.

4. A support apparatus according to claim 1 wherein said harness means comprise a pelvic girdle and a shoulder support for supporting said pelvic girdle from the shoulders of the human worker.

5. A support apparatus according to claim 1 including means for conducting water through said elongated rod means to the head assembly, and further including a vacuum conduit supported by said rod means and extending from the head assembly end thereof to a location on said rod means proximate the end thereof supported by said pivot assembly.

6. A support apparatus according to claim 1 wherein said harness means comprise a mounting yoke having a pair of yoke extensions adapted to extend on opposite sides of the human worker outside the hips thereof.

7. A support apparatus according to claim 1 wherein said harness means include a pelvic girdle supported to at least partially surround the hips and pelvic area of the human worker.

8. A support apparatus according to claim 1 wherein said pivot assembly includes means for pivotally supporting one end of said elongated rod means for pivotal movement with respect to said harness assembly.

9. A support apparatus according to claim 1 wherein said pivot assembly includes a universal joint.

10. A support apparatus according to claim 9 wherein said universal joint includes a ball and socket.

11. A support apparatus according to claim 9 wherein said universal joint comprises a wind surfer mast step.

* * * * *